US009816750B2

(12) United States Patent
Batey et al.

(10) Patent No.: US 9,816,750 B2
(45) Date of Patent: Nov. 14, 2017

(54) CRYOGENIC COOLING APPARATUS AND METHOD

(75) Inventors: Graham Batey, Witney (GB); Par Gustav Teleberg, Stockholm (SE); Anthony Matthews, Didcot (GB); Christopher Wilkinson, Wheatley (GB)

(73) Assignee: Oxford INstruments Nanotechnology Tools Limited (GB)

( * ) Notice: Subject to any disclaimer, the term of this patent is extended or adjusted under 35 U.S.C. 154(b) by 864 days.

(21) Appl. No.: 14/238,369

(22) PCT Filed: Aug. 13, 2012

(86) PCT No.: PCT/GB2012/051965

§ 371 (c)(1),
(2), (4) Date: Apr. 1, 2014

(87) PCT Pub. No.: WO2013/021217

PCT Pub. Date: Feb. 14, 2013

(65) Prior Publication Data

US 2014/0202179 A1 Jul. 24, 2014

(30) Foreign Application Priority Data

Aug. 11, 2011 (GB) ..... 1113844.3

(51) Int. Cl.
*F25B 9/12* (2006.01)
*F25D 29/00* (2006.01)

(52) U.S. Cl.
CPC ..... *F25D 29/001* (2013.01); *F25B 9/12* (2013.01)

(58) Field of Classification Search
CPC .... F25B 9/12; F25B 9/14; F25B 45/00; F25D 19/00–19/04

(Continued)

(56) References Cited

U.S. PATENT DOCUMENTS 3,894,403 A * 7/1975 Longsworth ..... F25D 19/006 505/892
4,672,823 A 6/1987 Benoit et al.
(Continued)

FOREIGN PATENT DOCUMENTS

EP 2309542 A1 4/2011
GB 2381977 A 5/2003
(Continued)

OTHER PUBLICATIONS de Waele, A.T.A.M., "Basic Operation of Cryocoolers and Related Thermal Machines;" published online: Jun. 10, 2011; Eindhoven University of Technology; pp. 1-58.
(Continued)

*Primary Examiner* — Jianying Atkisson
*Assistant Examiner* — Antonio R Febles
(74) *Attorney, Agent, or Firm* — Blank Rome LLP

(57) ABSTRACT

A method is provided of operating a cryogenic cooling system, in which a target region for receiving a sample is cooled by a dilution refrigerator containing an operational fluid. Firstly any operational fluid is removed from the dilution refrigerator. Target apparatus comprising the sample is loaded from a high temperature location to the target region. The target apparatus is then pre-cooled in the target region to a first temperature using a mechanical refrigerator. The operational fluid is then supplied to the dilution refrigerator and the dilution refrigerator operated so as to cool the target apparatus in the target location to a second temperature that is lower than the first temperature. A suitable system for performing the method is also disclosed.

30 Claims, 4 Drawing Sheets

(58) Field of Classification Search
USPC ..... 62/77, 149, 174, 292, 298
See application file for complete search history.

(56) References Cited

U.S. PATENT DOCUMENTS

| | | | | |
|---|---|---|---|---|
| 5,611,207 | A | 3/1997 | Hess | |
| 2002/0153957 | A1 | 10/2002 | Jordanov | |
| 2005/0229609 | A1* | 10/2005 | Kirichek | F25B 9/02 62/6 |

FOREIGN PATENT DOCUMENTS

| | | | |
|---|---|---|---|
| JP | 2008014878 | A | 1/2008 |
| JP | 2009074774 | A | 4/2009 |
| WO | WO-2010/002245 | A2 | 1/2010 |
| WO | 2010106309 | A2 | 9/2010 |
| WO | WO2010106309 | | 9/2010 |

OTHER PUBLICATIONS

Batey, G., et al.; "Integration of Superconducting Magnets with Cryogen-free Dilution Refrigerator Systems;" Cryogenics 49 (2009); Sep. 25, 2009; pp. 727-734.

Craig, et al., "Hitchhiker's Guide to the Dilution Refrigerator;" revised Aug. 21, 2004, version 2.00; pp. 1-20.

Niculae A. et al.: "Optimized readout methods of silicon drift detectors for high-resolution X-ray spectroscopy", Nuclear Instruments & Methods in Physics Research. Section A: Accelerators, Spectrometers, Dectectors, and Associated Equipment, Elsevier BV, North-Holland, Netherlands, vol. 568, No. 1; Nov. 30, 2006 (pp. 336-242).

K. N. Chaffin, "A $He^3$-$He^4$ Dilution Refrigerator System", Thesis in Physics, May 1978, 83 pages.

P. Hilton, et al., "A Novel Top-Loading 20 mK/15 T Cryomagnetic System", Japanese Journal of Applied Physics, vol. 26, 1987, Supplement 26-3; 2 pages.

L. M. Hernandez et al., "Bottom-Loading Dilution Refrigerator with Ultrahigh Vacuum Deposition Capability", Review of Scientific Instruments, vol. 73, No. 1, Jan. 2002, 4 pages.

Vericold_Flyer, "Top-Loading Cryogen-Free 4K Cryostat", VeriCold Technologies, 2008, 5 pages.

Vericold_Flyer, "Crogen-Free Dilution Refrigerator", VeriCold Technologies, 2006, 3 pages.

F. Pobell, "Matter and Methods at Low Temperatures", Springer-Verlag Berlin Heidelberg, 2007, 12 pages.

Cryofree Ultra Low Temperatue Systems, Triton Product Family, Oxford Instruments, 2010, 8 pages.

"Triton200 Cryofree Dilution Refrigerator", Operator Handbook, Oxford Instruments, issue 2.2, 2009, 135 pages.

* cited by examiner

CRYOGENIC COOLING APPARATUS AND METHOD

REFERENCE TO RELATED APPLICATION

The present application is a National Stage of International Application No. PCT/GB2012/051965, filed Aug. 13, 2012, Published as WO2013/021217 on Feb. 14, 2013, and claims the benefit of GB Patent Application No. 1113844.3, filed Aug. 11, 2011, whose disclosures are hereby incorporated by reference in their entirety into the present disclosure.

FIELD OF THE INVENTION

The invention relates to a cryogenic cooling apparatus and a method for using such an apparatus.

BACKGROUND TO THE INVENTION

When operating cryogenic equipment for low temperatures (less than 100 kelvin) or ultra low temperatures (less than 4 kelvin), there is often a need to change a sample at the cold part of the equipment. With conventional equipment using liquid cryogens such as helium or nitrogen, this is usually done by warming the equipment up and opening the equipment, or removing a part of the equipment and warming that up. The sample is then changed at room temperature. As this can be a slow process, some conventional cryogenic systems using liquid cryogens are fitted with more rapid sample change mechanisms that allow the majority of the system to remain cold. A key challenge with these systems is that the sample is entered into the equipment at room temperature, typically around 300K and then moved to another position where thermal contact is made with a body at a much lower temperature which in some systems can be lower than 1K. In systems using liquid cryogens the sample and associated mounting and connection equipment is usually pre-cooled either by passing it through cold cryogen gas on its way in to the system or by passing cold cryogen gas or liquid through the sample transfer mechanism, this reduces the thermal shock both on the sample and on the equipment.

More recently, cryogenic systems that do not require the addition of liquid cryogens or that only require liquid nitrogen during the initial cool down have been developed. These are generally known as cryogen-free systems. These systems use a mechanical cooler such as a GM cooler, Stirling cooler or a pulse tube to provide the cooling power. Because the cooling power of commercially available coolers is somewhat lower than the cooling power available from a reservoir of liquid cryogen, these systems can typically take longer to warm up, change the sample and cool down. There is therefore a considerable need for a method of changing samples in cryogen-free systems without the need to warm up the entire system.

With cryogen free systems there are a number of technical challenges when attempting to load a warm sample in to a cold cryostat. Firstly, the internals of the system are usually contained within a sealed vacuum vessel to reduce heat load. Secondly, within that sealed vacuum vessel, the sample space is usually enclosed by one or more radiation shields to further reduce the heat load. Thirdly, there are no liquid cryogens available to pre-cool the sample as it moves from room temperature to the cold mounting body. Also, electrical contacts need to be remotely made to the sample when it is loaded in the cryostat.

A number of these challenges are addressed in our earlier patent application WO2010/106309. In that application there is described a system in which a sample holding device is arranged to be coupled releasably via a thermal connector to one or more cold bodies within the vacuum chamber of the system so as to provide one or more stages of pre-cooling of the sample supported by the sample holding device. This apparatus is effective in providing staged pre-cooling of the sample prior to it attaining its operational or base temperature. Nevertheless, some challenges remain, particularly surrounding the need for extensive manual intervention in order to effect the sequential thermal couplings required to cool the sample.

For the case of cryogen cooling apparatus which comprises a dilution refrigerator system, any significant heat load which is applied rapidly to the system may cause a catastrophic failure in the relatively delicate components of the dilution refrigerator. There is therefore a need to provide automatic cooling and safe loading of samples, into cooling apparatus (particularly cryogen-free apparatus) which contains a dilution refrigerator for operating at ultra-low temperatures. It is these problems which the present invention has been devised to address.

SUMMARY OF THE INVENTION

In accordance with a first aspect of the present invention we provide a method of operating a cryogenic cooling system, in which a target region for receiving a sample is cooled by a dilution refrigerator containing an operational fluid, the method comprises: a) removing the operational fluid from the dilution refrigerator; b) moving target apparatus comprising the sample from a high temperature location to the target region; c) pre-cooling the target apparatus in the target region to a first temperature using a mechanical refrigerator; d) providing the operational fluid to the dilution refrigerator; and e) operating the dilution refrigerator using the operational fluid so as to cool the target apparatus in the target location to a second temperature that is lower than the first temperature.

The invention provides for the "warm" loading of the sample to the target region. Notably, the apparatus is not required to be brought up to atmospheric conditions during such loading and, furthermore, no pre-cooling is applied before the target apparatus is installed at the target region. This is made possible by the removal of the operational fluid from the dilution refrigerator and the pre-cooling of the target apparatus once it is in situ. The operational fluid is returned to the dilution refrigerator once much or all of the pre-cooling has been achieved. The dilution refrigerator thereafter may take over the cooling and further cool the target apparatus to an operational base temperature.

The invention provides comparable loading and unloading times with other known methods. However, the invention is advantageous over such methods in that the use of in situ pre-cooling allows greater automation of the method since the process is simpler and does not involve as many intricate mechanical procedures (such as thermal pre-cooling using the radiation shields of a cryostat).

The removal of the operational fluid from the dilution refrigerator according to step (a) prevents damage to the relatively delicate dilution refrigerator caused by the rapid and large heat input resulting from the insertion of the target apparatus from a high temperature environment. Whilst in principle the operational fluid may be removed in its liquid form, it is preferable to convert the liquid to a gas and then remove the gas from the dilution refrigerator. Thus the method typically comprises heating the operational fluid so as to cause it to become fully gaseous and removing the operational fluid to an external location.

In principle, additional pre-cooling could be used in association with the removal of the liquid from the dilution refrigerator, however the method is more efficient and also more amenable to automation if the method comprises only performing a cooling operation upon the target apparatus once the target apparatus is positioned within the target region. Typically the positioning of the target apparatus in the target region comprises attaching the target apparatus to a thermally conductive member so as to provide thermally conductive cooling of the target apparatus using the conductive member. Such an attachment may be performed by various mechanisms such as using biased clips. However, in order to ensure a good thermal contact, typically the coupling is performed using bolts.

The pre-cooling according to step (c) is an important part of the method since, during this step, extraction of the majority of the heat from the target apparatus occurs within the cooling system. The pre-cooling is typically achieved by causing coolant (such as helium gas) to flow within a pre-cooling circuit located in thermal contact with the mechanical refrigerator and the target region. Thus, the cooling power of the mechanical refrigerator is transmitted to the target region and indeed to other parts of the apparatus. Whilst the pre-cooling circuit is advantageous to deliver the pre-cooling effect, it also acts as a potential source of heat thereby providing a heat load to the dilution refrigerator once at the base temperature. In order to reduce this effect, typically the coolant is removed from the pre-cooling circuit following step (c).

Whilst in step (a), the operational fluid may be removed by the use of heaters attached to one or more of a still and mixing chamber of the dilution refrigerator, the pre-cooling circuit may also be used to great effect to assist in this process. Thus during step (a), the method preferably comprises providing coolant at a high temperature into the pre-cooling circuit so as to heat the target region. It will be appreciated that the cryogenic cooling system typically comprises a cryostat which has an interior volume which is evacuated during use and in which the cooled parts of the mechanical refrigerator and dilution refrigerator are positioned when in use, together with the target apparatus in the target region. The low temperature and low pressure environment within the cryostat represent significantly contrasting conditions with respect to the external environment. The first temperature is typically the base temperature of the coldest stage of the mechanical refrigerator; a typical example of such a temperature is 3 to 4 K. The second temperature is typically only attainable using the dilution refrigerator and may be a few millikelvin. The high temperature location referred to in step (b) is typically the ambient environment having a temperature of approximately 293 to 298 kelvin. It will be appreciated that such an ambient environment is also typically at atmospheric pressure such that a sample may be loaded into the target apparatus under ambient conditions.

Whilst the majority of the cooling of the sample occurs within the vacuum chamber, typically the sample is placed in a low pressure atmosphere which is similar to that within the chamber of the cryostat at a location external to the cryostat wall, such as when mounted to a gate valve. This may be achieved using a separate vacuum vessel which may be mounted to the exterior of the cryostat thereby providing a "vacuum lock".

Prior to the loading of the sample and in particular prior to step (a) of the method, the system is typically already operational at its normal "cold" temperature and pressure conditions. Thus, prior to step (a), the dilution refrigerator is typically at a temperature such that part of the operational fluid within the dilution refrigerator is liquid. In contrast, having removed the operational fluid and later, at step (d) re-charged the dilution refrigerator with the operational fluid (but before this is partially liquefied), the temperature at this stage, with the sample loaded, is less than about 10 kelvin.

The target apparatus is preferably moved to the target region with the use of associated loading apparatus in the form of a loading assembly. Once within the target region, the target apparatus is connected thermally to an appropriate component such as a docking station within the target region. It is possible that the loading assembly may remain positioned within the apparatus during its normal operation after step (e). However, the presence of the loading assembly causes an undesirable heat load and therefore it is preferable that the target apparatus is released from the loading assembly and the loading assembly is retracted either to a nearby location within the cryostat chamber, or entirely removed from the apparatus.

As mentioned earlier, the invention according to the first aspect provides significant practical advantages over known methods since it allows for increased automation of the method. The method is therefore typically performed under the control of a control system. The control system preferably controls the removal and charging of the dilution refrigerator, the pre-cooling using the mechanical refrigerator and the later operation of the dilution refrigerator once at the cold temperature. Therefore much of the method may be automated, particularly the operation of the apparatus associated with the cooling of the sample within the cryostat. Unlike in other systems the manual part of the method is typically confined to the physical loading of the sample into the cryostat.

In accordance with the second aspect of the present invention we provide a cryogenic cooling system which comprises a dilution refrigerator arranged to use operational fluid to cool a target region at which target apparatus, comprising a sample, is positioned when in use; a pre-cool system, comprising a mechanical refrigerator, for cooling the target apparatus in the target region; and, a control system adapted when in use to remove the operational fluid from the dilution refrigerator before the target apparatus is received at the target region, to operate the pre-cool system so as to pre-cool the target apparatus in the target region to a first temperature using the mechanical refrigerator, to provide the operational fluid to the dilution refrigerator and to operate the dilution refrigerator using the operational fluid so as to cool the target apparatus in the target location to a second temperature that is lower than the first temperature.

It is preferred therefore that the cryogenic cooling system according to the second aspect of the invention performs the method according to the first aspect. It is also preferred that the system further comprises a storage vessel for storing the operational coolant, the storage vessel being selectively connectable to the dilution refrigerator. Thus in use, the storage vessel may contain a mixture of helium-3 and helium-4 isotopes to enable the operation of the dilution refrigerator. The storage vessel is typically at room temperature and contains a pressure slightly below that of the atmosphere, for example 0.75 atmospheres. This ensures that the possibility of coolant gas leaks to the external environment is reduced since helium-4 and, in particular, helium-3 are increasingly precious and expensive resources.

The system also preferably includes a pre-cool system which comprises a pre-cooling circuit arranged to supply a cooling fluid between the mechanical refrigerator and the target apparatus at the target region. Such a cooling fluid may take the form of helium-4 although the storage vessel is preferably selectively connectable to the pre-cool system such that the cooling fluid in this case is the operational fluid. The coolant in the pre-cool system is therefore typically a mixture of helium-3 and helium-4.

The apparatus arrangement within the chamber may take a number of different forms. Preferably, it comprises a plurality of spatially dispersed stages to which parts of the mechanical and dilution refrigerators are coupled. Such stages may take the form of thermal conductivity platforms spaced for example vertically above one another and held in relative position by very low thermal conductivity supports. Preferably one or more of the plurality of stages has an aperture for receiving the target apparatus, the said one or more apertures therefore defining a bore through which the target apparatus is caused to pass prior to arrive at the target region. Typically at least one of the apertures is provided by a baffle which is movable between an open position in which the aperture is accessible and a closed position in which the aperture is closed. Such baffles may be moveable using a drive mechanism (such as a rod) or may be biased into a closed position and only caused to open when the target apparatus is present to deflect them. This significantly reduces the heat load at the coldest parts of the system. When in use, each stage is typically at a different operational temperature.

A further advantageous feature of the system may be provided when the system comprises one or each of electrical and optical communication lines for communicating with the sample within the target region. Said lines are typically fixed within the apparatus, independently of the presence or absence of the target apparatus and the said lines are typically provided from an external location (for example the control system) to the target region. Thus it is preferred that the communication lines do not pass through any of the said one or more apertures. This allows the "heat sinking" of the lines which typically is effected by ensuring the lines are placed in good thermal contact with the various stages of the apparatus. Thermal contact may be achieved using clamps for example. This arrangement therefore substantially reduces the heat load caused by the lines which is a problem in known systems where the lines are provided along the "bore" of the apparatus. Electrical or optical connection, as appropriate, between the lines and the sample, is preferably effected using releasable push-fit connectors. For example high density co-axial connectors may be used with a typical frequency of up to 40 GHz. High density D.C. connectors may also be utilised, typically in addition to the co-axial connectors. This allows sample holders of up to 100 leads or 30-40 co-axial connections to be used. Utilising a "straight plug" design allows remote connection of the connectors in a single operation, thereby avoiding the need to screw multiple individual connectors together when loading the apparatus.

It will be understood that the cryogenic system described above is typically a cryogen-free system. Whilst such a system is not entirely absent any cryogenic fluids, the cryogen-free description is intended to mean that the achievement of a stable cold temperature in parts of the system does not rely on the evaporation of coolant from a coolant reservoir to which the cold part of the system is connected thermally. Typically therefore the primary cooling within such a cryogen-free system is provided by a mechanical refrigerator such as a GM cooler, Stirling cooler or pulse tube refrigerator (PTR).

The principle of the invention may be achieved using various cryostat and sample loading configurations. For example, the system may be a top-loading system, as is primarily described herein. However the system may alternatively be configured to be a bottom-loading system, in which case apertures with baffles may be provided through the radiation shields so as to allow the sample to be loaded. Other configurations including side-loading systems are also contemplated. The choice of loading configuration is dependent upon a number of factors including performance, intended functionality and engineering requirements. For example the cryostat may include a superconducting magnet which is cooled by the mechanical refrigerator allowing the performance of various experiments upon a sample placed within the magnet, such as nuclear magnetic resonance procedures. The presence of such a magnet makes a top or bottom-loading system preferable since such magnets normally are designed with a bore which is aligned with an axis along which the sample is passed into the cryostat.

BRIEF DESCRIPTION OF THE DRAWINGS

An example of a cryogenic cooling system and associated method are now described with reference to the accompanying drawings, in which.

DESCRIPTION OF PREFERRED EXAMPLE

An example of suitable apparatus for performing the invention is now described, followed by a description of an example method of using the apparatus.

Figure 1:
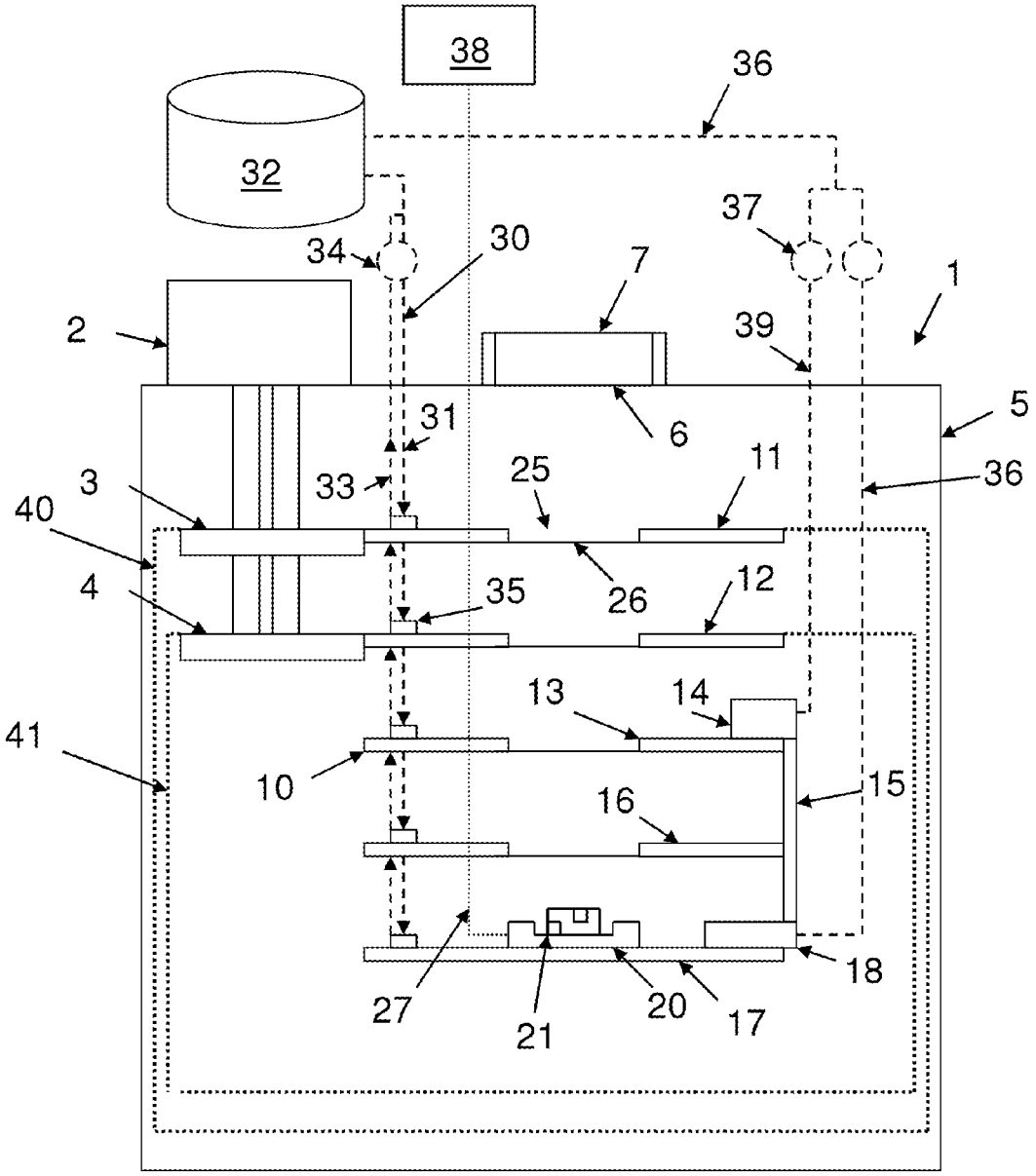
FIG. 1 is a schematic representation, partly in section, of a system according to the example.

With reference to FIG. 1, there is illustrated a schematic sectional view of the interior of a cryogen-free cooling apparatus the main part of which is a cryostat 1. Cryostats are well known in the art and are used to provide low temperature environments for various apparatus. The cryostat 1 is typically evacuated when in use, this being to improve the thermal performance by the removal of convective and conductive heat paths through any gas within the cryostat. The cryostat 1 in the present example is a cryogen-free cryostat in that it does not contain a reservoir of liquid helium, the cooling of the cryostat instead being achieved by use of conductive cooling from a mechanical refrigerator. However, as will be explained, despite the "cryogen-free" term, some coolant (in this case helium) is typically present within the cryostat when in use, including in the liquid phase.

The main cooling power of the cryostat 1, which enables it to be a cryogen-free system, is provided by a mechanical refrigerator (these also being referred to in the art as "cryocoolers"). In the present case the mechanical refrigerator takes the form of a pulse tube refrigerator (PTR) 2. PTRs are also known for use in cryogen-free applications and typically provide cooling power at one or more low temperature stages within the cryostat 1. In the present case, the PTR 2 cools a first stage 3 of the PTR to about 50 to 70 kelvin and a second stage 4 of the PTR to about 3 to 5 kelvin. The cryostat 1 is typically formed as a large hollow stainless steel cylinder which comprises an outer vacuum vessel 5 which contains an access opening via a central port 6 in a top surface of the vessel. The port 6 is fitted with a gate valve 7 positioned within the port 6 so as to allow suitable apparatus, such an experimental "probe" to pass into the interior of the cryostat 1 whilst maintaining the vacuum within the vacuum vessel 5.

A multi-stage assembly 10 is positioned within the cryostat, this acting as a tiered platform within the vacuum environment and to which is mounted most of the various apparatus within the cryostat for performing low temperature procedures such as experiments. In the present case, the multi-stage assembly is suspended from the upper part of the cryostat 1 and takes the form of a number of similar circular discs arranged one above another in a vertical array. The discs are formed from high conductivity copper and are spaced apart from one another by low thermal conductivity rods. A total of five discs are provided in this case, each representing a different "stage" and having a different operational temperature when the system is in use.

The topmost stage 11 is connected directly with the first stage 3 of the PTR 2. During operation of the PTR 2, the topmost stage 11 is cooled to the operational temperature of the PTR first stage 3. Therefore, the topmost stage achieves a temperature of around 50 to 70 kelvin. The copper disc is also connected thermally with an outer radiation shield 40 which is therefore also held at about 50 to 70 kelvin during the operation of the PTR 2. A second disc having similar form to the topmost stage 11 forms a second stage 12 and is positioned beneath the topmost stage 11 and spaced therefrom. In a similar manner to the connection the topmost stage 11 to the first stage of the PTR, this second stage 12 is connected directly to the second stage 4 of the PTR 2. In addition, an inner radiation shield 41 is also connected to this second stage 4 of the PTR 2. Each of the outer 40 and inner 41 radiation shields substantially encloses the remaining discs (forming third to fifth stages of the multi-stage assembly 10) and associated equipment (which may include a magnet), with the outer radiation shield 40 also substantially enclosing the inner radiation shield 41. During use of the PTR 2, the PTR second stage 4, together with the second stage 12, and inner radiation shield 41 achieve a temperature of between 3.5 and 4 kelvin.

A third disc in the "stack" of discs, forming a third stage 13, is positioned beneath the second stage 12 and again spaced therefrom. This is used as a platform for supporting the still 14 of a dilution refrigerator 15. During use, for example when performing experiments upon a sample, the temperature of the third stage 13 and still 14 is typically between 0.6 and 0.8 kelvin. A further disc in the form of a fourth stage 16 is positioned beneath the third stage 13. The function of this fourth stage is to act primarily as an intermediate thermal stage. Finally, beneath the fourth stage is a fifth disc acting as a fifth stage 17 which functions as a platform for supporting a sample when in use and for holding a mixing chamber 18 of the dilution refrigerator 15. The fifth stage 17 typically reaches an operational temperature of about 7 to 10 millikelvin and therefore the fourth stage 16 achieves an operational temperature of about 70 to 150 millikelvin when the dilution refrigerator 15 is fully operational.

The fifth stage supports a docking station 20, this being arranged to receive target apparatus in the form of a sample carrier which supports a sample (described below). The docking station 20 also includes connectors 21 so as to provide optical and/or electrical contacts with the sample carrier. As is indicated in FIG. 1, each of the first to fourth stages contains an aperture 25, these being positioned centrally in each disc such that each of the apertures 25 aligns to provide a central bore passing vertically through each of the upper four stages. The apertures also align with the gate valve 7 of the port 6. The purpose of the apertures is to allow for the insertion of a loading assembly which contains the sample retained in a sample carrier. Thus the system in this example is a "top-loading" system.

Since the alignment of the apertures 25 provides a bore from the coldest part of the system in a "target region" (which contains the docking station 20) and the warmer part of the system adjacent to the gate valve 7, each of the apertures 25 is provided with a corresponding baffle 26. The apertures are generally circular in shape and each baffle 26 is also in the form of a disc. Each baffle is hinged (not shown in FIG. 1) to a region adjacent to the edge of the aperture 25 and is biased to a closed position, for example using a spring, such that the baffle 26 covers the aperture 25 in each case. This reduces any possible convection or radiation heat load between the port and the target region. In an alternative mechanism the baffles may be manually rotated away from their apertures by turning a drive rod that has a rotating seal mounted on the top of the cryostat.

Optionally the cryostat may comprise a magnet for providing a strong magnetic field (for example, in excess of 10 tesla) within a bore in the magnet and in which bore the sample is positioned when loaded. In such cases the magnet may be located in the lower part of the cryostat, beneath the multi-stage assembly 10. Such a magnet may be cooled to around 3-4K using the PTR 2. In this case the disc forming the fifth stage may also be provided with an aperture and baffle which are aligned with the apertures in the stages above. This allows for the use of a sample carrier which is elongate and has an upper section connected to the fifth stage and a lower section which projects downwards through the aperture into the centre of the magnet at which position the sample itself is located. The invention is particularly beneficial for use with cryostats containing magnets since the thermal mass of such magnets causes them to require significant cooling periods (for example about 30 hours for a 12 tesla magnet) in order to achieve operational temperatures. The present invention reduces the frequency of such lengthy cooling periods being needed, by avoiding the need to warm the magnet when changing the samples.

Figure 2:
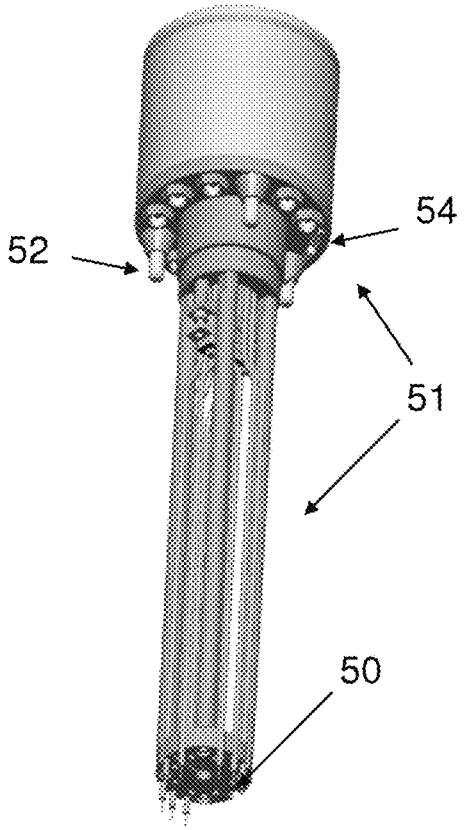
FIG. 2 shows an example sample carrier for use with an optional magnet in the cryostat.

With reference to FIG. 2, external to the cryostat 1, a sample 50 is mounted to a sample carrier 51. The sample carrier is shown without the sample attached in FIG. 2 although the position of the sample when attached is indicated by the reference numeral 50. The sample carrier is elongate in this example having a large upper section and a narrower lower section. The lower section which contains the sample 50 is designed to be lowered within the bore of a magnet (not shown in FIG. 1), whereas the upper section is designed to be connected thermally to the lowest temperature stage 17 of the multi-stage assembly 10 using three socket screws 52. The lower section comprises copper rods which cool the sample 50 by thermal conduction. The sample carrier 51 has space for a number of electrical and/or optical connectors 54 to allow connection to connectors 21 on the docking station 20 in the target region of the cryostat. This arrangement allows multiple push-fit connectors to be used which gives high flexibility in use. It also allows for the wiring between the sample and external apparatus to pass between the stages of the multi-stage assembly 10 in a manner such that this is spaced separately from the apertures 25, rather than down the loading assembly "probe tube" and this provides significant thermal benefits.

Figure 3:
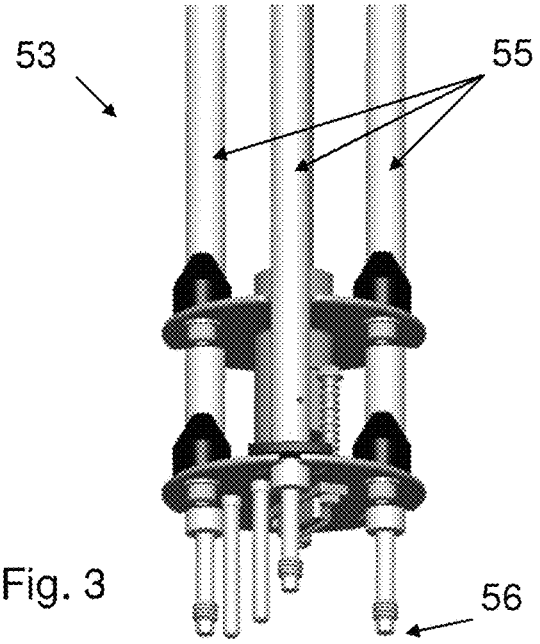
FIG. 3 shows a lower part of a loading assembly.
Figure 4:
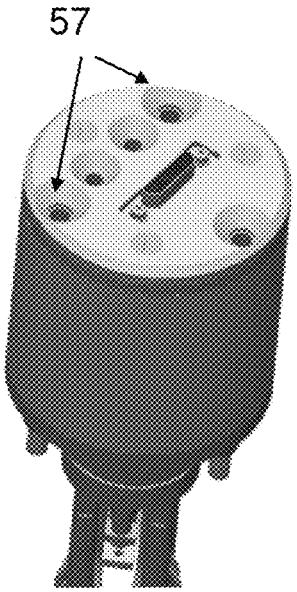
FIG. 4 show the upper part of the example sample carrier with which the loading assembly engages.

A loading assembly 53 is also provided, the lower part of which is shown in FIG. 3, to which the sample carrier 51 is coupled when loading and unloading the sample carrier 51 from the cryostat. The loading assembly 53 is generally formed from three elongate rods 55 each being connected with a respective hex key 56, which project from the ends of the rods 55. Each hex key has a thread formed in its circumferential surface at a distance from the end of the hex key 56. The hex keys are designed to fit into an upper part of the corresponding socket screws 52. However, in order for each hex key 56 to engage with the socket screws of the sample carrier 51, each must firstly pass through a bore 57 in the upper section of the carrier 53. These bores 57 are shown in FIG. 4. Each bore is fitted with a screw thread in its inner wall, this being complementary to the screw thread upon each hex key 56. In order for the hex key 56 to reach the socket screws it must be inserted into the bore 57 until the respective threads clash. The rod (and hex key 56) much then be rotated such that the complementary threads pass through one another and allow the hex key to engage in the socket of the socket screw.

Figure 5:
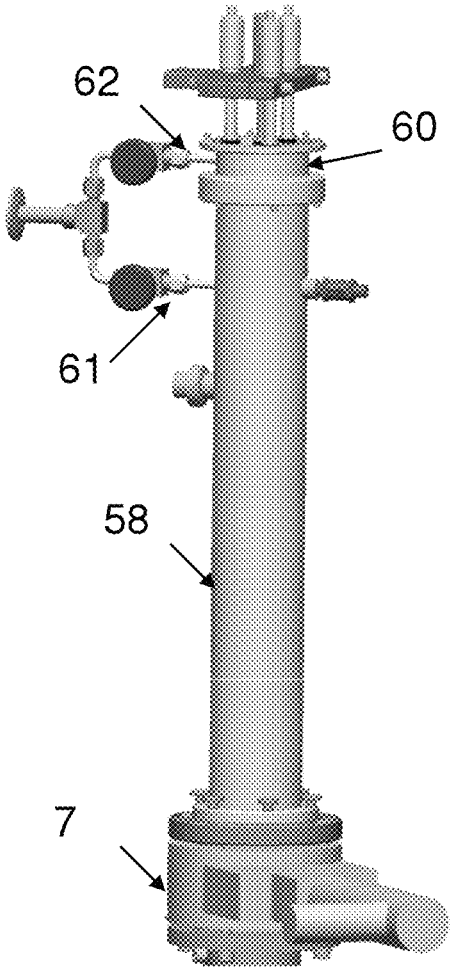
FIG. 5 shows a vacuum vessel arrangement for loading the sample.

FIG. 5 illustrates how the sample carrier 53 is loaded into the cryostat 1. A tube and flange assembly forms a vacuum vessel 58 positioned on the top of the cryostat 1 (since this example is a top-loading arrangement). The vacuum vessel 58 surrounds the rods of the loading assembly 53, the ends of these rods being visible as projecting from the top of the apparatus in FIG. 5. The vacuum vessel 58 is open at a lower end, this end being sealed by the gate valve 7 when assembled to the cryostat 1. At the opposite end of the vacuum vessel 58, each of the rods of the loading assembly passes through a pair of vertically displaced o-ring seals. The small volume between the seals provides a separate vacuum space 60. The vacuum vessel 58 and vacuum space 60 are each connected to a vacuum port 61 and 62 respectively. Each of these ports is connected, through a respective valve to a vacuum pump. Thus, port 61 is used to evacuate the vessel 58 and port 62 allows any air leaking through the first seal, when the rods of the loading assembly 53 are moved, to be pumped away through the corresponding valve in the port 62.

In operation, a sample 50 is loaded on to the sample carrier 51 and electrical or optical connections are made. The sample carrier 51 is then mounted on the end of the loading assembly 53. The rods are retracted through the sliding o-ring seals until the sample carrier is fully within the vacuum vessel 58. The vacuum vessel 58 is then attached to the gate valve 7 and air is pumped out of the vacuum vessel 58 through ports 61 and 62. When a similar vacuum is established on both sides of the gate valve 7, the system is ready for the gate valve to be opened.

Returning to FIG. 1, the wiring provided between the stages within the cryostat is illustrated at 27, this notably being separate from the apertures 25 and providing electrical (in some cases optical or a combination of each) connection with the connectors 21.

As is also illustrated in FIG. 1, a pre-cool circuit 30 is also provided, this comprising a closed loop system in which a cooling line 31 provides a path for gaseous coolant from an external storage vessel 32 via an external pump 34 into the cryostat 1, and into a heat exchanger arranged to exchange heat with the first stage 3 of the PTR2. The cooling line 31 continues to a second heat exchanger so as to cool the gaseous coolant within the line further, to a few kelvin. Further heat exchangers are also provided upon each of the remaining 3 (third, fourth and fifth stages), an example being illustrated at 35. A return line 33 provides a continuation of the cooling line 31 allowing the coolant path to flow in a counter-flow manner, thereby providing counter-flow cooling of the cooling line 31, the return line passing up through the cryostat. With the use of appropriate valves the coolant in the return line may be circulated back into the cooling line or returned to the external storage vessel 32. The cooling and return lines are placed in fluid communication with the external storage vessel during filling and emptying operations of the pre-cool circuit 30. At other times, when the pre-cool circuit is performing a cooling function the valves are operated to connect the top of the cooling and return lines, at a location external to the cryostat, so as to provide a pumped circuit. This way, the pre-cooled system transmits the cooling power of the PTR stages 3 and 4 to each of the stages 11, 12, 13, 16, 17. This pre-cooling system is effective in cooling the lower stages discs to a temperature approximately equal to that of the second stage of the PTR (between 3.5 and 4 kelvin). Notably, such a temperature also ensures that the dilution refrigerator 15 may operate since it is sufficient to cool a mixture of helium-3 and helium-4 which comprises the operational fluid of the dilution refrigerator 15 and maintain the mixture in the required liquid phases. As will be explained, following the use of the pre-cooling system, a second coolant circuit is used in association with the dilution refrigerator 15 to cool the sample down to millikelvin temperatures.

The second coolant circuit is provided to operate the dilution refrigerator 15. Here a first line in the form of a condensing line 36 connects a first side of the cooling circuit, via external pumps 37, to the interior of the dilution refrigerator 15. A second line, as a still pumping line 39 connects a second side of the dilution refrigerator 15 to the pumps 37, the first and second lines providing the second coolant circuit. One of the pumps 37 is a powerful turbomolecular pump for providing a high vacuum on the low pressure side of the circuit (for example less than 0.1 mbar); another is a small compressor pump for pumping coolant in the condensing line (at 0.5 to 2 bar). Appropriate valves are also provided, external to the cryostat to connect the second cooling circuit to the interior of the external storage vessel 32. Hence the valves and pumps may be used to fill and empty the dilution refrigerator 15 as well as to operate the dilution refrigerator by connecting the first and second lines and provide a pumped circuit. When in use operational fluid (a mixture of helium 4 and helium 3 isotopes) is provided from the external storage vessel 32, liquefied in the dilution refrigerator and then circulated according to the normal operation of such a refrigerator. The operational coolant in the vessel 32 is the same coolant as is used in the pre-cool circuit.

A control system 38 is illustrated connected with the wiring 27. However, in practice the control system controls each of the parts of the system including the operation of the refrigerators, the pumps and associated valves, the monitoring of sensors and the operation of other ancillary equipment to perform desired procedures on the sample. A suitable computer system may be used to achieve this.

Figure 6:
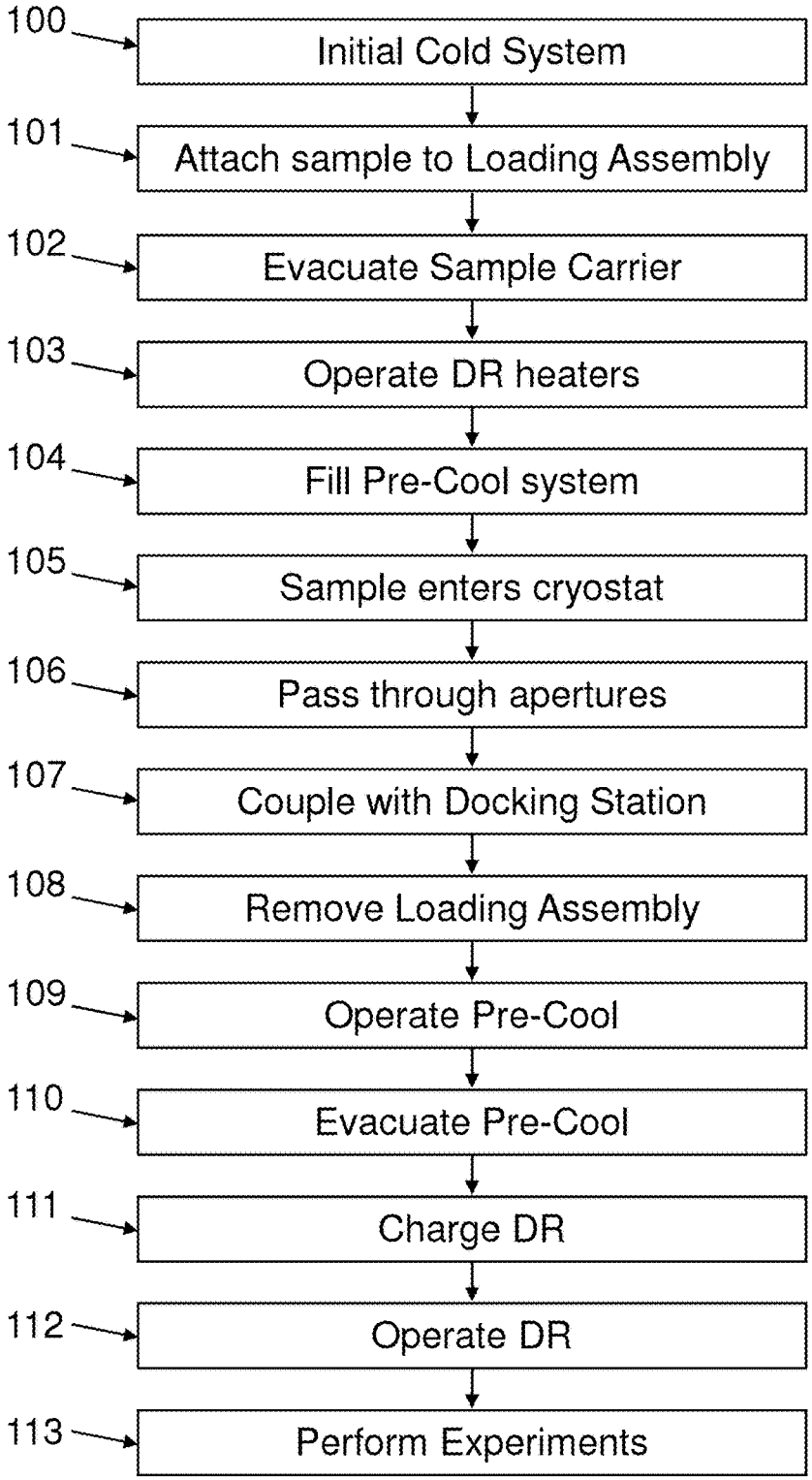
FIG. 6 is an example of a flow diagram showing the performance of the method.

An example method of using the apparatus is now described with reference to FIG. 6. The method begins at step 100 in which the apparatus is already in a "cold" state. Specifically, in this state the PTR 2 is operational and cooling the outer 40 and inner 41 radiation shields together with the topmost stage 11 and second stage 12 of the multi-stage assembly 10. It will be recalled that the operational temperatures are about 50-70K for the components cooled by the first stage 3 of the PTR 2, and 3.5-4K for those components cooled by the second stage 4.

At this time the dilution refrigerator 15 is also operational in a conventional manner, this cooling the lower stages 13,16,17 to temperatures of about 0.6-0.8K, 70-150 mK and 7-10 mK respectively. The interior of the cryostat 1 is held at high vacuum, having an air pressure of less than $10^{-6}$ mbar and the pre-cooling circuit comprising the cooling line 31 and return line 33 are each evacuated to a pressure of about 0.1 mbar or less. The evacuation of the pre-cooling circuit is achieved using the same turbomolecular pump of pumps 37 which operate the dilution refrigerator 15.

As described earlier, at step 101, a sample 50, upon which ultra-low temperature experiments are desired to be performed, is mounted, in a manual process, to the sample carrier 51 (the target apparatus). This involves the rotation of the rods 55 of the loading assembly 53 such that the threads on the hex keys 56 pass through their complementary threads within the bores 57 in the sample carrier 51. The target apparatus is then attached to the loading assembly 53 and the whole assembly mounted to the top of the gate valve 7 of the apparatus. The sample carrier is retained within the vacuum vessel 38 which is then evacuated at step 102 so as to equalize the pressure with that of the interior of the cryostat 1. This procedure takes about 20 minutes.

During or shortly after the performance of step 102, at step 103 the system controller 38 operates heaters (not shown in FIG. 1) on each of the still 14 and mixing chamber 18 so as to warm the dilution refrigerator 15, causing the evaporation of the helium isotope mixture within the dilution refrigerator 15. The valves in the second cooling circuit allow the gas to vent into the external storage vessel 32.

Whilst some of the operational coolant within the dilution refrigerator 15 still remains as a liquid, in order to increase the speed of the evaporation process, at step 104, the controller 38 operates a valve and pump 34 in the cooling line 31 to supply a helium gas mixture from the vessel 32 (this being the gas mixture received from the dilution refrigerator 15) into the pre-cooling system. It should be noted that the PTR 2 remains operational throughout the steps of the method described here. However, during this stage, the influx of gas into the circuit is provided at a high flow rate which means that the heat load is higher than that which the PTR stages 3,4 are able to extract over a short time period. The warm gas, despite being partially cooled by the PTR stages 3,4, arrives at the three lowest temperature stages (discs) of the system and causes them to warm to a temperature of about 10K. This provides a further heat load at the dilution refrigerator, therefore increasing the evaporation rate of the coolant mixture.

Once the target apparatus has reached an equal pressure to the cryostat chamber, the gate valve 7 is opened and each of the loading assembly and the coupled target apparatus is driven manually downwards through the gate valve 7 into the cryostat 1 at step 105.

It will be appreciated that, during the movement of the loading assembly 53, parts of the assembly move between a low pressure region and an ambient pressure region. The vacuum vessel 38 with double "O"-ring sliding seal protects the main vacuum chamber within the cryostat during loading and unloading operations. Each of the vacuum vessel 58 and vacuum space 60 is evacuated using a turbomolecular pump. When the gate valve 7 is opened a valve connecting the turbo molecular pump to the port 61 is closed. A similar valve for the port 62 remains open to allow the pump to remove any small amount of air that leaks through the primary seal as the drive rods of the loading assembly slide downwards (or upwards in the event of the rods being retracted).

The loading assembly 53 with sample carrier is loaded manually so as to move the sample carrier through the gate valve 7 to the first stage 11 position. The downward motion of the assembly 53 deflects the baffle 26 to one side, against the biasing, and the sample carrier 51 is pushed down progressively through the apertures 25 and baffles 26 of the stages 12, 13, 16 at step 106.

The loading assembly 53 is then driven to a final position to allow connection of the sample carrier 51 to the docking station 20. At step 107 the sample carrier 51 is coupled with the docking station 20. Attachment and thermal contact between the sample carrier 51 and the docking station 20 is achieved through bolted contacts using the socket screws 52. The screw threads on the socket screws 52 on the sample carrier are engaged in mating screw threads on the docking station 20. The hex keys 56 located upon each of the drive rods 55 mate with conformal M5 socket heads in the socket screws 52 allowing a torque of up to 10 Nm to be applied to each "bolt" to ensure strong coupling with the docking station. Meanwhile the connector 54 on the target apparatus mates with the connector 21 installed upon the docking station 20. This is a push-fit connection which is releasable by applying a modest force.

Once the sample carrier is connected to the docking station 20 by means of the socket screws 52 the loading assembly 53 can then be retracted. This is achieved by retracting the hex keys 56 a small distance to disengage them from the socket screws 52. The rods 55 are then lifted and rotated to pass the threads upon the hex keys through the complementary threads upon the sample carrier 51. This allows the loading assembly 53 to be fully retracted from the cryostat through the gate valve 7 in order to further reduce the heat load. The retraction of the loading assembly 53 therefore allows the biased baffles 26 to close. This occurs at step 108.

It will be understood that the sample loads into the system from room temperature. Hence upon achieving thermal contact with the docking station, the target apparatus is rapidly cooled by the combination of the low temperature and thermal mass of the lowest stage of the multi-stage assembly. The thermal contact with the docking station provides a large heat load which causes the remaining liquid within the dilution refrigerator to evaporate. As before, this gas is passed to the external storage vessel. The sample carrier 51 at this time is at a temperature of about 20 to 30K and it therefore requires further cooling to achieve the desired base temperature. The further cooling is applied in two stages.

The first of these stages occurs at step 109, where the controller 38 operates the pre-cooling system. The pump 34 in the pre-cooling circuit is operated such that the helium ¾ mixture is circulated through the cooling line 31 and the return line 33, back through the pump 34 and into the cooling line 31 again in a closed circuit. The pressure within the pre-cooling circuit is controlled as a function of the temperature and is gradually reduced (from an initial 2 bar to about 0.5 bar) as the temperature drops. The operation of the pre-cooling circuit reduces the temperature of the multi-stage assembly 10.

The pre-cool system is then evacuated at step 110 by returning the coolant to the vessel 32, since otherwise this will cause a heat load on the lowest temperature stage. A low pressure of 0.1 mbar or less is achieved in the pre-cool system using the turbomolecular pump of the pumps 37.

Once the lowest stage achieves a temperature of about 10K, the controller 38, operates the pumps 37 and associated valves to fill the dilution refrigerator with a predetermined "charge" of helium ¾ mixture (step 111). The temperature of all parts of the dilution refrigerator 15 is such that the mixture remains gaseous at this time.

Further cooling of the gas mixture in the dilution refrigerator 15 is achieved by circulating the gas mixture in the condensing line 36 and still pumping line 39. A pressure in excess of 1 bar is used. The gas in the condensing line 36 undergoes heat exchange with the first and second stages of the PTR 2 (this not being shown in FIG. 1). Furthermore, the gas is expanded across an impedance on the entry to the dilution refrigerator which causes a further cooling effect. As a result the gas mixture condenses within the dilution refrigerator as the temperature reduces to below 4 kelvin.

Once sufficient condensation within the dilution refrigerator has occurred, the dilution refrigerator is operated in a conventional manner at step 112, this being effected by the circulation of operational coolant through the condensing line 36 and still pumping line 39. This causes the lowest three stages of the multi-stage assembly to achieve their operational base temperature. It will be appreciated that the above description is a simplification of a known dilution refrigerator cycle in which helium 3 atoms are pumped across a phase boundary in the mixing chamber.

Finally, at step 113, the system achieves a stable operational base temperature and the desired experiments to be performed upon the sample are then implemented. It will be appreciated that the time taken from the loading of the sample to the achievement of the operational base temperature is about 6 to 8 hours.

Once the required experiments or other procedures have been performed on the sample then the method is repeated in order to withdraw the sample. In particular, the loading apparatus is positioned above the gate valve and evacuated. The dilution refrigerator is then evacuated and the pre-cool system charged with warm coolant in order to assist this. The loading device is then passed into the cryostat 1 and docks with the target apparatus already mounted to the docking station. The rods and hex keys 56 are then operated to couple the loading assembly to the sample carrier 51 of the target apparatus and decouple the target apparatus from the docking station 20. The loading assembly with the target apparatus is then withdrawn through the apertures, with the spring-loaded baffles closing behind the sample carrier 51 as it is withdrawn. Once outside the gate valve 7, the vacuum vessel 58 is vented with dry nitrogen to warm the sample carrier 51 without causing ice build up. The procedure may then be repeated with a new sample. Here the steps 103 to 105 will not need repeating since the pre-cooling system will already contain warm gas and the dilution refrigerator 15 will have had its operational coolant removed. The temperature of the fifth stage will already be at about 20-30 kelvin due to the recent thermal contact with the warm loading assembly 53 when removing the sample carrier 51.

The invention claimed is:

1. A method of operating a cryogenic cooling system, in which a target region for receiving a sample is cooled by a dilution refrigerator containing an operational fluid, the method comprising performing the following steps (a)-(e) in order:

a) removing the operational fluid from the dilution refrigerator;

b) moving target apparatus comprising the sample from a high temperature location to the target region;

c) pre-cooling the apparatus in the target region to a first temperature using a mechanical refrigerator;

d) providing the operational fluid to the dilution refrigerator; and e) operating the dilution refrigerator using the operational fluid so as to cool the target apparatus in the target location to a second temperature that is lower than the first temperature.

2. A method according to claim 1, wherein the target region is at a lower temperature than the high temperature location during step (b).

3. A method according to claim 2, wherein said lower temperature is below 30 kelvin and wherein thermal contact of the target apparatus with the target region during step (b) causes a heat transfer from the target apparatus to the target region.

4. A method according to claim 1, wherein the target region remains at a temperature below 100 kelvin during steps(a)-(e).

5. A method according to claim 1, wherein the cryogenic cooling system comprises a cryostat having an interior volume which is in an evacuated state during steps (a)-(e).

6. A method according to claim 1, wherein step (a) comprises heating the operational fluid so as to cause it to become fully gaseous, and removing the operational fluid to external location.

7. A method according to claim 1, wherein step (b) comprises only performing a cooling operation upon the target apparatus once the target apparatus is positioned within the target region.

8. A method according to claim 1, wherein the positioning of the target apparatus in the target region comprises attaching the target apparatus to a thermally conductive member so as to provide thermally conductive cooling of the target apparatus using the conductive member.

9. A method according to claim 1, wherein step (c) comprises causing coolant to flow within a pre-cooling circuit located in thermal contact with the mechanical refrigerator and the target region.

10. A method according to claim 9 wherein the coolant in the pre-cooling circuit and the operational fluid are the same coolant.

11. A method according to claim 9, where, following step (c) the coolant is removed from the pre-cooling circuit.

12. A method according to claim 9, further comprising, during step (a), providing coolant at a high temperature into the pre-cooling circuit so as to heat the target region.

13. A method according to claim 1, wherein the high temperature location is positioned within an ambient environment.

14. A method according to claim 1 wherein, prior to step (a), the dilution refrigerator is at a temperature such that part of the operational fluid is liquid.

15. A method according to claim 1, wherein, prior to step (d) the temperature of the dilution refrigerator is less than about 10 kelvin.

16. A method according to claim 1, wherein in step (b) the target apparatus is moved to the target location whilst the target apparatus is attached to a loading assembly and wherein, once in the target region, the target apparatus is released from the loading assembly and the loading assembly is retracted.

17. A method according to claim 1, wherein steps (a) and steps (c) to (e) are performed automatically under the control of a control system.

18. A cryogenic cooling system comprising:

a dilution refrigerator arranged to use operational fluid to cool a target region at which target apparatus, comprising a sample, is positioned when in use;

a pre-cool system, comprising a mechanical refrigerator, for cooling the target apparatus in the target region; and, a control system adapted when in use to remove the operational fluid from the dilution refrigerator before the target apparatus is received at the target region, to operate the pre-cool system so as to pre-cool the target apparatus in the target region to a first temperature using the mechanical refrigerator, to provide the operational fluid to the dilution refrigerator and to operate the dilution refrigerator using the operational fluid so as to cool the target apparatus in the target location to a second temperature that is lower than the first temperature.

19. A cryogenic system according to claim 18, wherein the mechanical refrigerator comprises any of: a Gifford-McMahon cooler, a Stirling cooler or a pulse tube refrigerator.

20. A cryogenic system according to claim 18, further comprising a storage vessel for storing operational coolant, the storage vessel being selectively connectable to the dilution refrigerator.

21. A system according to claim 18, wherein the pre-cool system comprises a pre-cooling circuit arranged to supply a cooling fluid between the mechanical refrigerator and the target apparatus at the target region.

22. A cryogenic system according to claim 21, wherein the storage vessel is selectively connectable to the pre-cool system and wherein the cooling fluid is the operational fluid.

23. A cryogenic system according to claim 18, wherein the operational fluid is a mixture of helium-3 and helium-4.

24. A cryogenic system according to claim 18, further comprising a plurality of spatially disposed stages to which parts of the mechanical and dilution refrigerators are coupled.

25. A cryogenic system according to claim 24, wherein one or more of the plurality of stages has an aperture for receiving the target apparatus and wherein the said one or more apertures defines a bore through which the target apparatus is caused to pass.

26. A cryogenic system according to claim 25, wherein at least one of the apertures is provided with a baffle which is moveable between an open position in which the aperture is accessible and a closed position in which the aperture is closed.

27. A cryogenic system according to claim 18, further comprising one or each of electrical and optical communication lines for communicating with the sample, the said lines being fixed within the apparatus, independently of the presence or absence of the target apparatus and the said lines being provided from an external location to the target region.

28. A cryogenic system according to claim 27, wherein the communication lines do not pass through any of the said one or more apertures.

29. A cryogenic system according to claim 18, wherein the cryogenic system comprises a cryogen-free system.

30. A non-transitory computer readable medium storing a program causing a controller to perform the steps (a) and (c) to (e) of the method of claim 1 in order.

* * * * *